US006485068B1

(12) United States Patent
Sauvé

(10) Patent No.: US 6,485,068 B1
(45) **Date of Patent: *Nov. 26, 2002**

(54) FALL ARRESTOR AND LOCKDOWN DEVICE FOR VERTICAL LIFT DOORS

(76) Inventor: Raymond Sauvé , 830 Pine Ridge Ct., Stone Mountain, GA (US) 30087

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/989,970

(22) Filed: Dec. 12, 1997

(51) Int. Cl.[7] ..... E05C 1/12

(52) U.S. Cl. ..... 292/171; 292/DIG. 36; 160/191

(58) Field of Search ..... 292/38, 171, DIG. 36, 292/164, 166, 167, 165, 169, 163, 168; 49/322; 160/191

(56) References Cited

U.S. PATENT DOCUMENTS 291,724 A * 1/1884 Hamilton
794,241 A * 7/1905 Michaud
1,113,667 A * 10/1914 Mahaj
1,615,120 A * 1/1927 Fischer
2,198,079 A * 4/1940 Ferris
2,472,791 A * 6/1949 Clark
3,276,165 A * 10/1966 Purcell
4,080,757 A * 3/1978 Westerman ..... 49/322
4,884,831 A * 12/1989 Emon ..... 292/38
5,371,970 A * 12/1994 Ganikon ..... 49/280
5,655,800 A * 8/1997 De Marco ..... 292/167

* cited by examiner

*Primary Examiner*—Gary Estremsky

(57) ABSTRACT

The apparatus is a fall arrestor and lockdown device for vertical lift doors, particularly single membrane fabric vertical lift doors. A pulley on a sensing arm engages the cable which raises and lowers the door. Alternatively, the sensing arm is directly attached to a belt. The sensing arm is mechanically linked to a spring loaded pin reciprocating within a tubular housing. When the cable or belt is tensioned, the sensing arm rotates upwardly to a position where the pin is retracted and the spring compressed thereby allowing the door to move vertically. However, when the cable or belt is not tensioned, the spring urges the pin to an extended position to engage regularly spaced apertures within the guide channel. When the cable or belt is not tensioned due to a cable or belt failure, the device operates as a fall arrestor. When the cable or belt is not tensioned because the door is fully lowered to the ground, the device acts as a lockdown device.

11 Claims, 9 Drawing Sheets

FALL ARRESTOR AND LOCKDOWN DEVICE FOR VERTICAL LIFT DOORS

BACKGROUND OF THE INVENTION

1. Field of the Invention

This invention pertains to a fall arrestor and lockdown device for vertical lift doors, particularly single membrane fabric vertical lift doors.

2. Description of the Prior Art

Many applications, such as aircraft hangars, today require large vertical lift doors. This need has been addressed by large single membrane fabric vertical lift doors. However, in the absence of proper safety equipment, such doors have the potential for rapid falls caused by cable or lift belt breaks. It is therefore important that such doors have fall arrestors which are responsive to cable or lift belt breaks. It is also important to realize that such fall arrestors ordinarily are activated only in unexpected cable or lift belt break situations. Such intermittent activation can lead to latent inoperability, such as contamination from debris due to lack of use, which is not detected prior to an unexpected cable or lift belt break.

Some prior art devices use friction methods for fall arrestor systems. These arrestor systems damage the door jamb and/or door beams thereby leading to extended downtime and costly repair. Further, they can allow the door leaf to continue falling after engagement by sliding on debris found in the jambs due to low maintenance or high contamination.

Additionally, it is important for such vertical lift doors to be automatically locked upon closing, so that surreptitious entrance cannot be gained by merely lifting the lower crossbar of the single membrane fabric vertical lift door.

OBJECTS AND SUMMARY OF THE INVENTION

It is therefore an object of this invention to provide a fall arrestor for vertical lift doors, particularly single membrane fabric vertical lift doors.

It is therefore a further object of this invention to provide a fall arrestor for vertical lift doors, particularly single membrane fabric vertical lift doors, which is simple in construction and reliable.

It is therefore a further object of this invention to provide a fall arrestor for vertical lift doors, particularly single membrane fabric vertical lift doors, which positively and reliably engages the door jamb without damage to the door jamb.

It is therefore a further object of this invention to provide a fall arrestor for vertical lift doors, particularly single membrane fabric vertical lift doors, which is periodically cycled to aid in detecting latent inoperability.

It is therefore a further object of this invention to provide a fall arrestor for vertical lift doors, particularly single membrane fabric vertical lift doors, which can be reset quickly after repair of a failed cable or lift belt.

It is therefore a further object of this invention to provide a lockdown device for vertical lift doors, particularly single membrane fabric vertical lift doors.

It is therefore a final object of this invention to provide a fall arrestor and lockdown device for vertical lift doors, particularly single membrane fabric vertical lift doors, which is relatively inexpensive to manufacture.

These and other objects are attained by a fall arrestor and lockdown device which is integral with the guide system on the bottom beam of the door and rigidly attached thereto. The fall arrestor and lockdown device includes a spring activated pin device which is attached by mechanical linkage to a rotatable cable or lift belt tension sensing arm. A wire rope or cable passes through the sensing arm. Alternatively, a lift belt can be attached directly to the arm. When the cable or lift belt is "charged" (tension is applied to the cable or lift belt), the sensing arm rotates thereby moving the linkage, retracting the pin and compressing the coil spring. The pin retracts to clear apertures that are placed in the door jamb according to door-width parameters. In the event that the cable or lift belt breaks, the force of the compressed coil spring overcomes the lift applied by the cable or lift belt in the sensing arm and consequently the pin extends. With pressure applied by the coil spring to the pin, the pin is forced outwardly against the door jamb tracking until it reaches an aperture in the jamb. The pin then fires into the aperture where it then comes to rest upon hitting the edge of the side frame. Upon activation of the arrestor system, the beam fall due to cable or lift belt failure is arrested.

The lockdown feature is accomplished when the door reaches its bottom height. The cable or lift belt will lose tension due to the transfer of load from the cable to the ground. This load transfer allows the sensing arm to articulate or rotate in a controlled manner. The pin thereby extends into a jamb placed into the side frame thereby locking the door. This locking provides resistance to unwanted intrusion as well as resistance to beam lift due to catenary forces form wind loading to the fabric. Upon reinitiation of the door cycle, the tension from the cable or lift belt again charges the arrestor system retracting the pin for the arrestor mode.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
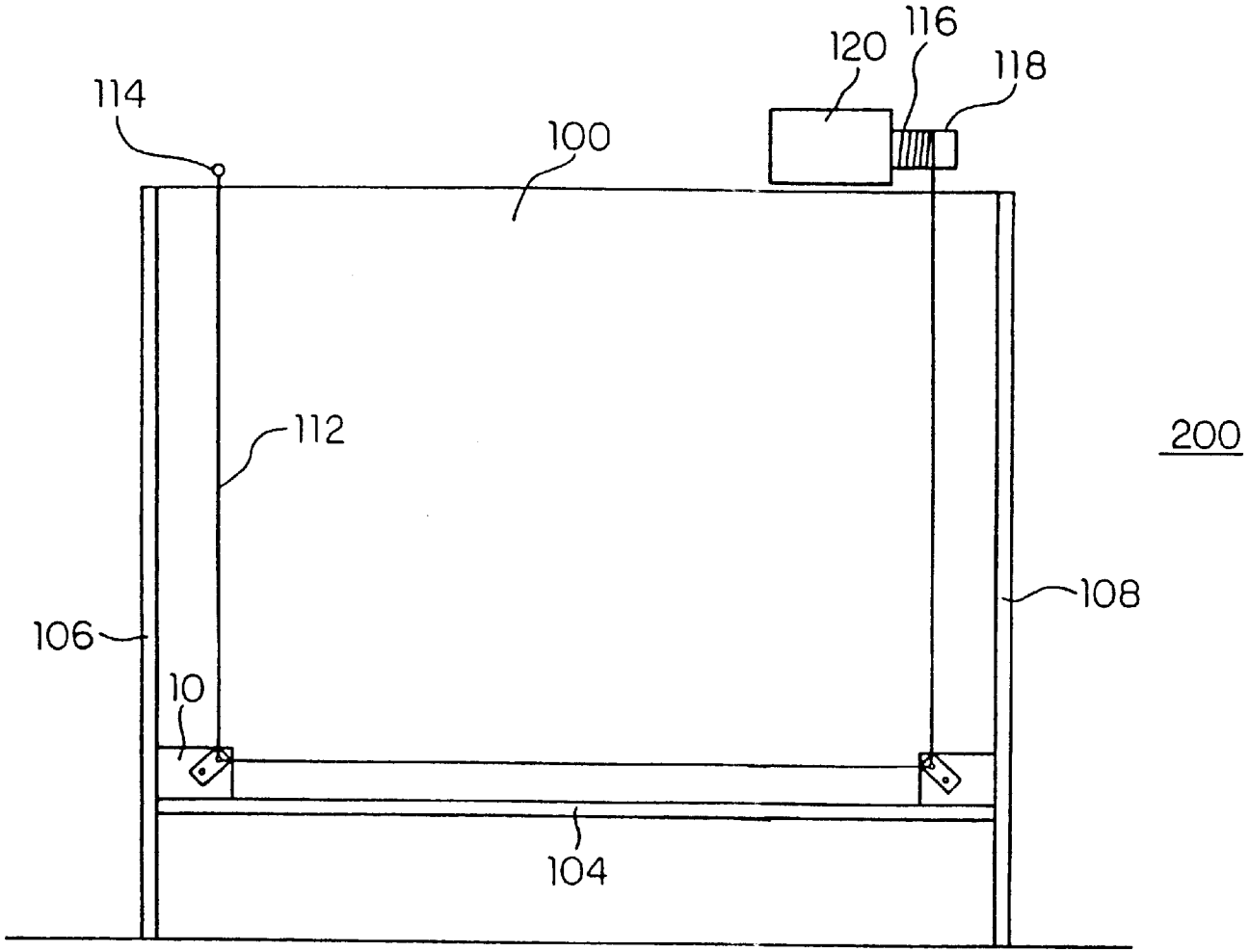
FIG. 1 is a plan view of a vertical lift door using the fall arrestor and lockdown device of the present invention.

Referring now to the drawings in detail, wherein like numerals refer to like elements throughout the several views, one sees that FIG. 1 shows a vertical lift door 100, typically made of a single membrane fabric 102 with a lower metallic beam 104 riding within guide channels 106, 108 which are fixed to wall 200. Guide channels 106, 108 have regularly spaced apertures 110 as illustrated in phantom in FIG. 5. Fall arrestors and lockdown devices 10, 10' are rigidly attached to (or integral with) both sides of lower metallic beam 104. Cable 112 is fixed at a first end 114 to a first side of wall 200 at a position proximate to the upper end of vertical lift door 100. Cable 112 extends vertically downward from first end 114, passes through fall arrestor and lockdown device 10, extends horizontally immediately above lower metallic beam 104, passes through fall arrestor and lockdown device 10', and extends vertically upward to second end 116 which is engaged by spool 118 of rotary motor 120. Vertical lift door 100 is raised and lowered by winding and unwinding cable 112 about spool 118.

Figure 2:
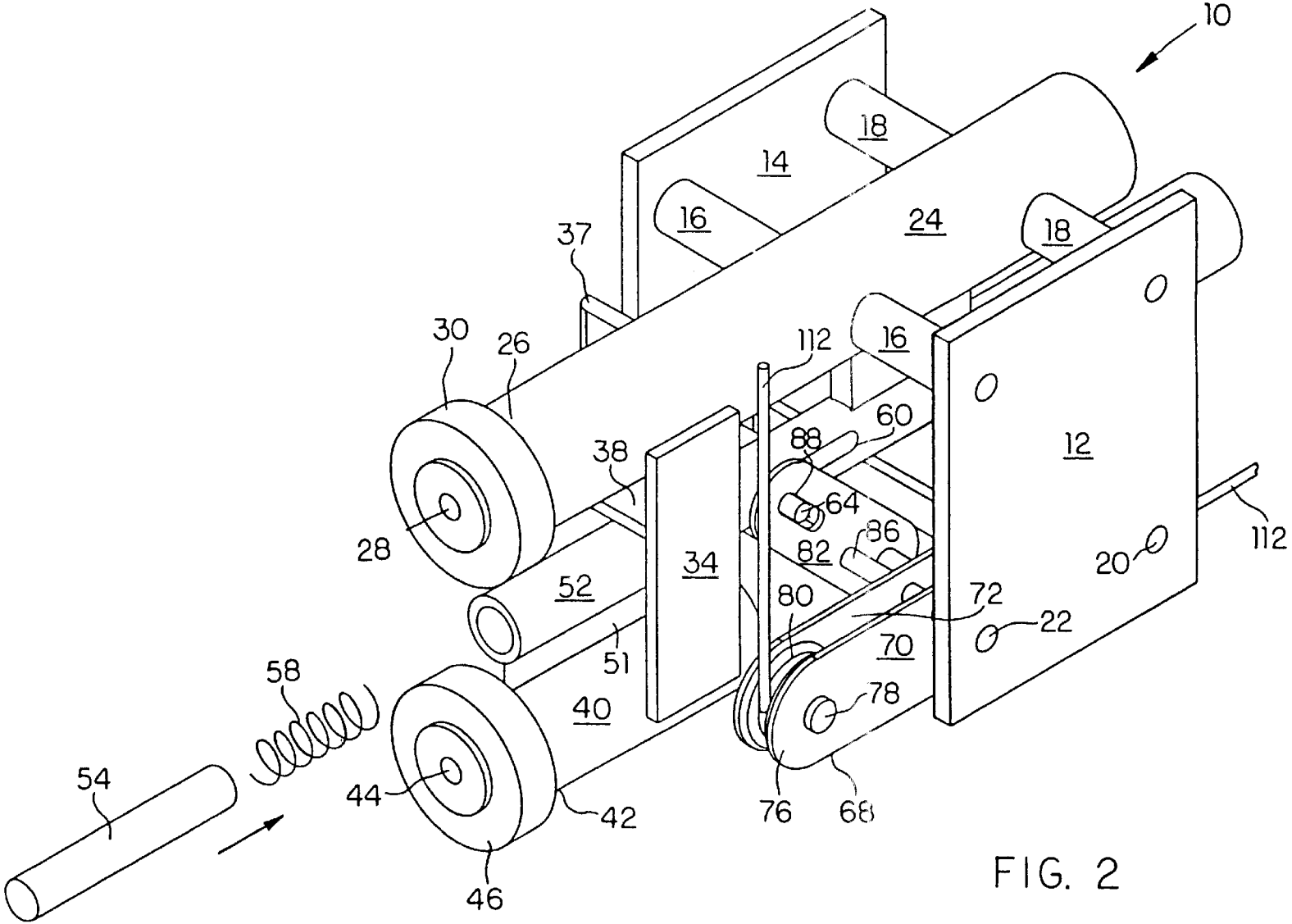
FIG. 2 is an exploded perspective view of the fall arrestor and lockdown device of the present invention.
Figure 5:
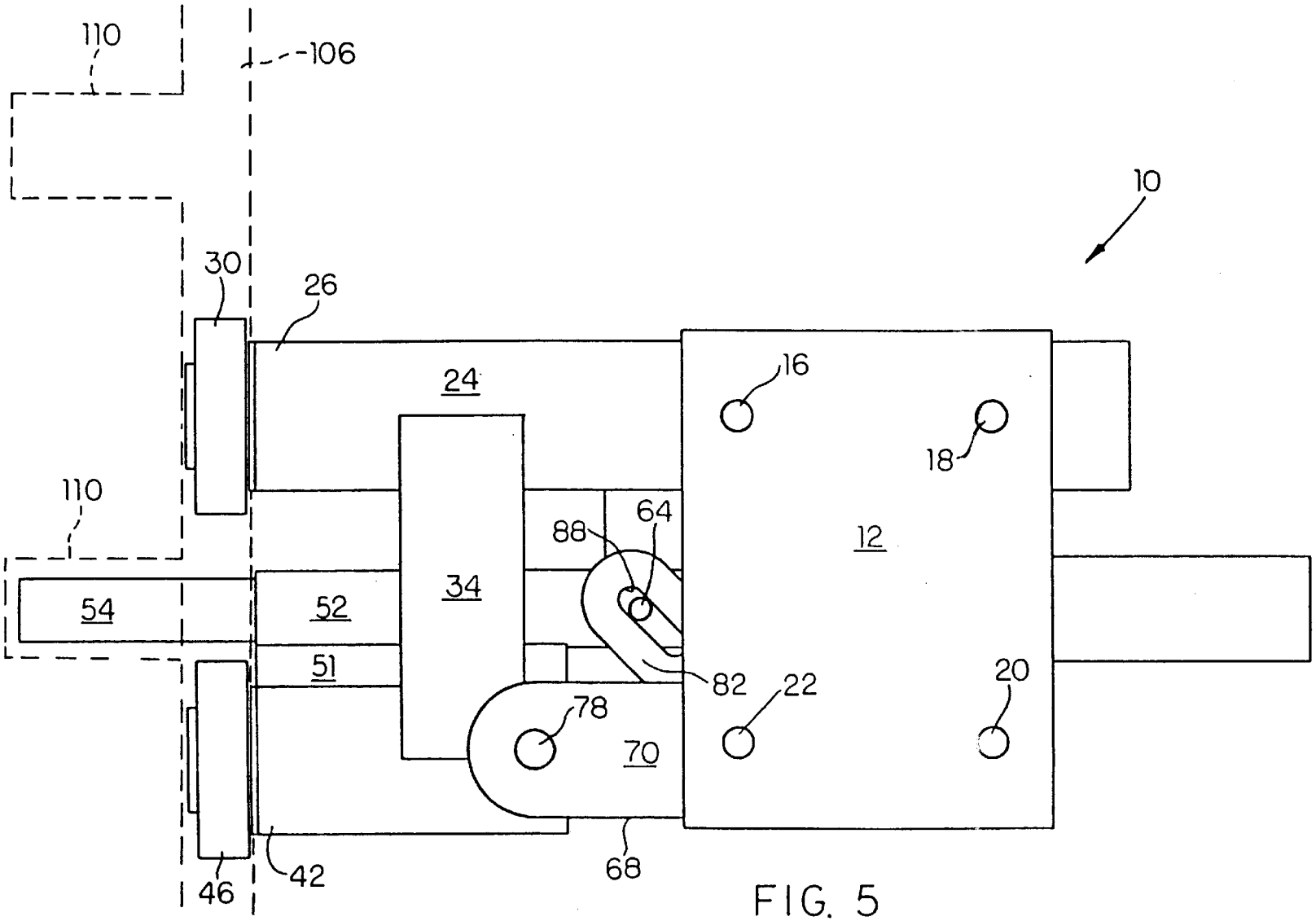
FIG. 5 is a side plan view of the fall arrestor and lockdown device of the present invention with the pin in an extended position through the aperture in the guide channel of the door jamb, the guide channel being shown in phantom.

FIG. 2 is an exploded perspective view of the fall arrestor and lockdown device 10. Horizontally opposed vertical rectangular plates 12, 14, spaced apart by horizontal posts 16, 18, 20, 22, provide the structural support for fall arrestor and lockdown device 10. Posts 16 and 18 pass through and are rigidly attached to upper roller support 24. Forward end 26 of upper roller support 24 includes axis 28 about which upper roller 30 is journalled for rotation. As shown in FIG. 5, upper roller 30 travels within guide channel 106.

Figure 7:
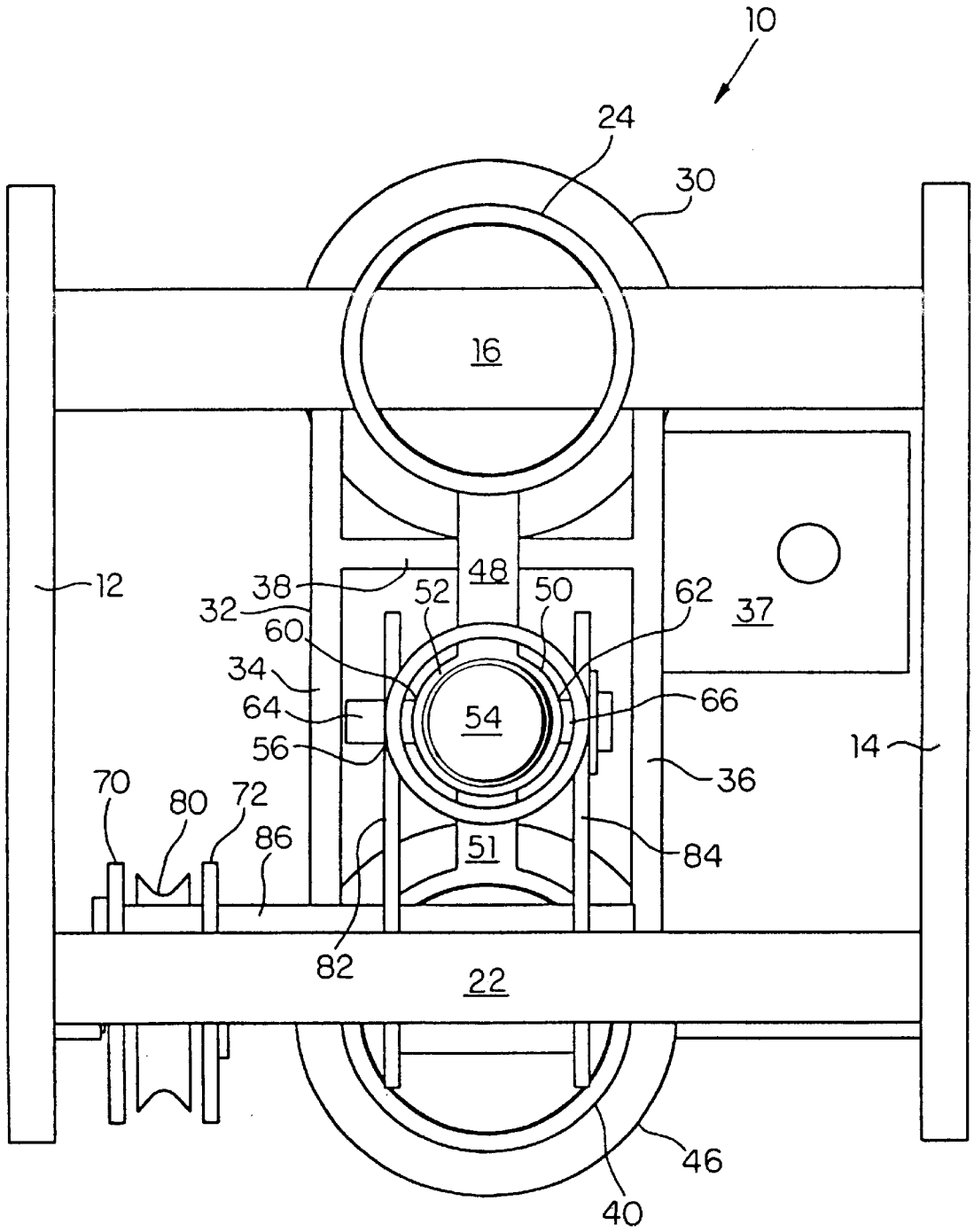
FIG. 7 is a rear plan view, partly in cross section along section 7—7 of FIG. 6, of the fall arrestor and lockdown device of the present invention with the pin in an extended position.

H-shaped support 32 comprises two vertical members 34, 36 (see FIG. 7) and a horizontal cross member 38. Flange 37 extends from vertical member 36. H-shaped support 32 secures lower roller support 40 underneath and parallel to upper roller support 24. Vertical members 34, 36 are welded or otherwise fastened to the sides of upper roller support 24 and lower roller support 40. Forward end 42 of lower roller support 40 includes axis 44 about which lower roller 46 is journalled for rotation. As shown in FIG. 5, lower roller 46 travels within guide channel 106.

Additionally, upper central vertical web portion 48 extends from a central lower portion of upper roller support 24 to an upper portion of pin tubular housing 50 and lower central vertical web portion 51 extends from a lower portion of pin tubular housing 50 to lower roller support 40.

Horizontal cross member 38 passes below upper roller support 24 and is integral with a portion of upper central vertical web portion 48 and spaces vertical members 34, 36 apart from each other.

Pin tubular housing 50 includes forward section 52 through which pin 54 reciprocates and rearward section 56 of increased diameter which houses coil spring 58 (see FIG. 2) which urges pin 54 to the extended position and which is compressed when pin 54 is in the retracted position. Pin tubular housing 50 further includes opposed lateral slots 60, 62.

Pin 54 includes integral opposed lateral linkage pins 64, 66 which extend through opposed lateral slots 60, 62, respectively.

Figure 6:
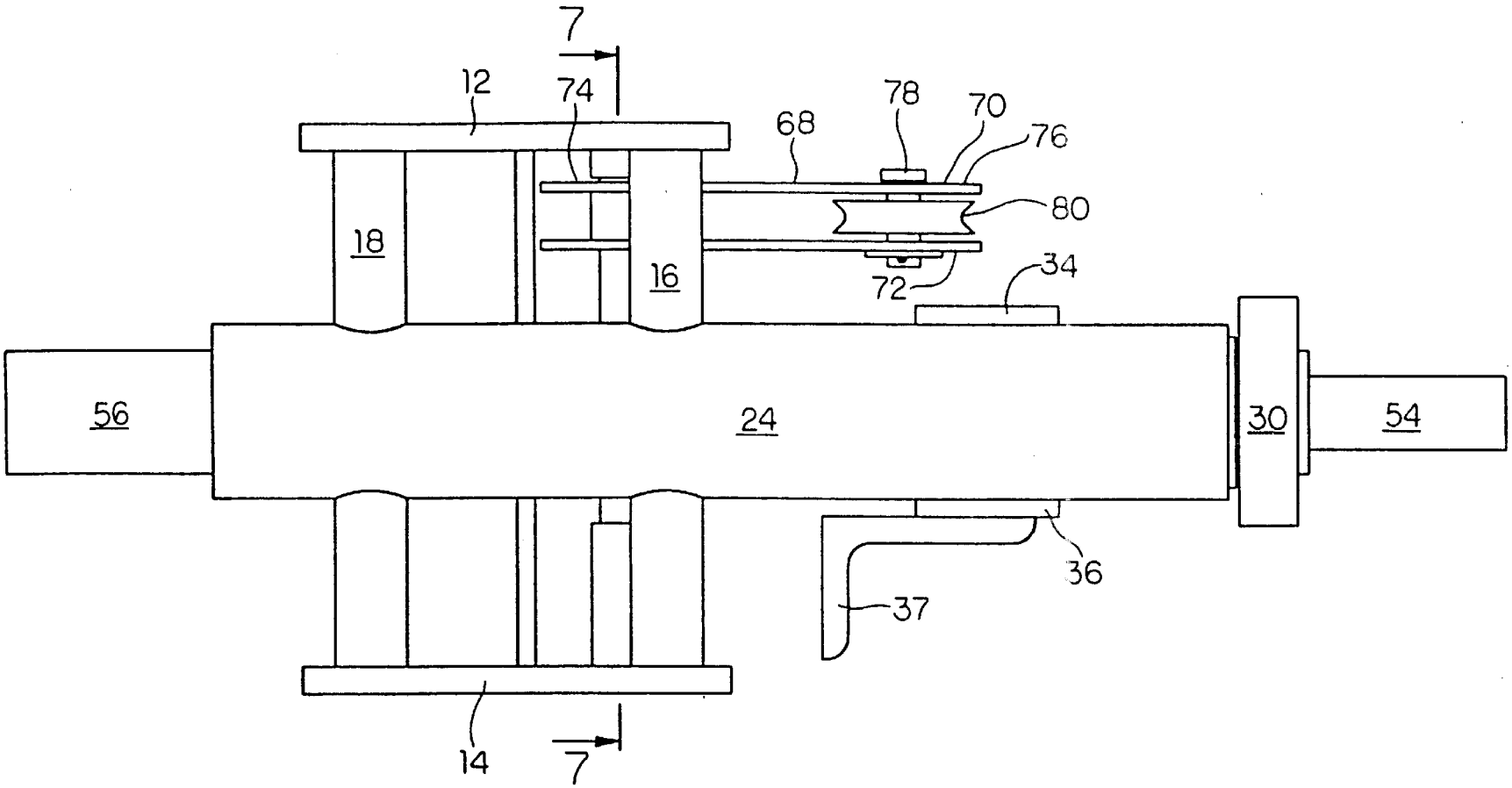
FIG. 6 is a top plan view of the fall arrestor and lockdown device of the present invention with the pin in an extended position.

Sensing arm 68 includes two parallel arm members 70, 72 which on a proximal end 74 (see FIG. 6) are journalled for rotation about post 22. Distal end 76 of sensing arm 68 includes an axle 78 about which pulley 80 rotates. Pulley 80 engages cable 112. Linkage arms 82, 84 are likewise journalled for rotation about post 22, are mechanically secured to sensing arm 68 via rod 86 and thereby rotate in concert with sensing arm 68. Linkage arms 82, 84 include linkage slots 86, 88, respectively which are engaged by lateral linkage pins 64, 66, respectively, which are integral with pin 54.

The position of sensing arm 68 is responsive to the tension on cable 112. Further, the sensing arm 68 is mechanically linked to pin 54 via bar 86, linkage arms 82, 84 and lateral linkage pins 64, 66. Therefore, when there is tension on cable 112, the sensing arm 68 is rotated upwardly to the position shown in FIG. 3. This position, via the above described mechanical linkage, retracts pin 54 into pin tubular housing 50 and compresses coil spring 58 within rearward section 56 of pin tubular housing 50. The upward rotation of sensing arm 68 is stopped by the lateral linkage pins 64, 66 abutting the rearward sections of slots 60, 62. Additionally, a mechanical stop can be provided in the interior of plate 12.

Figure 3:
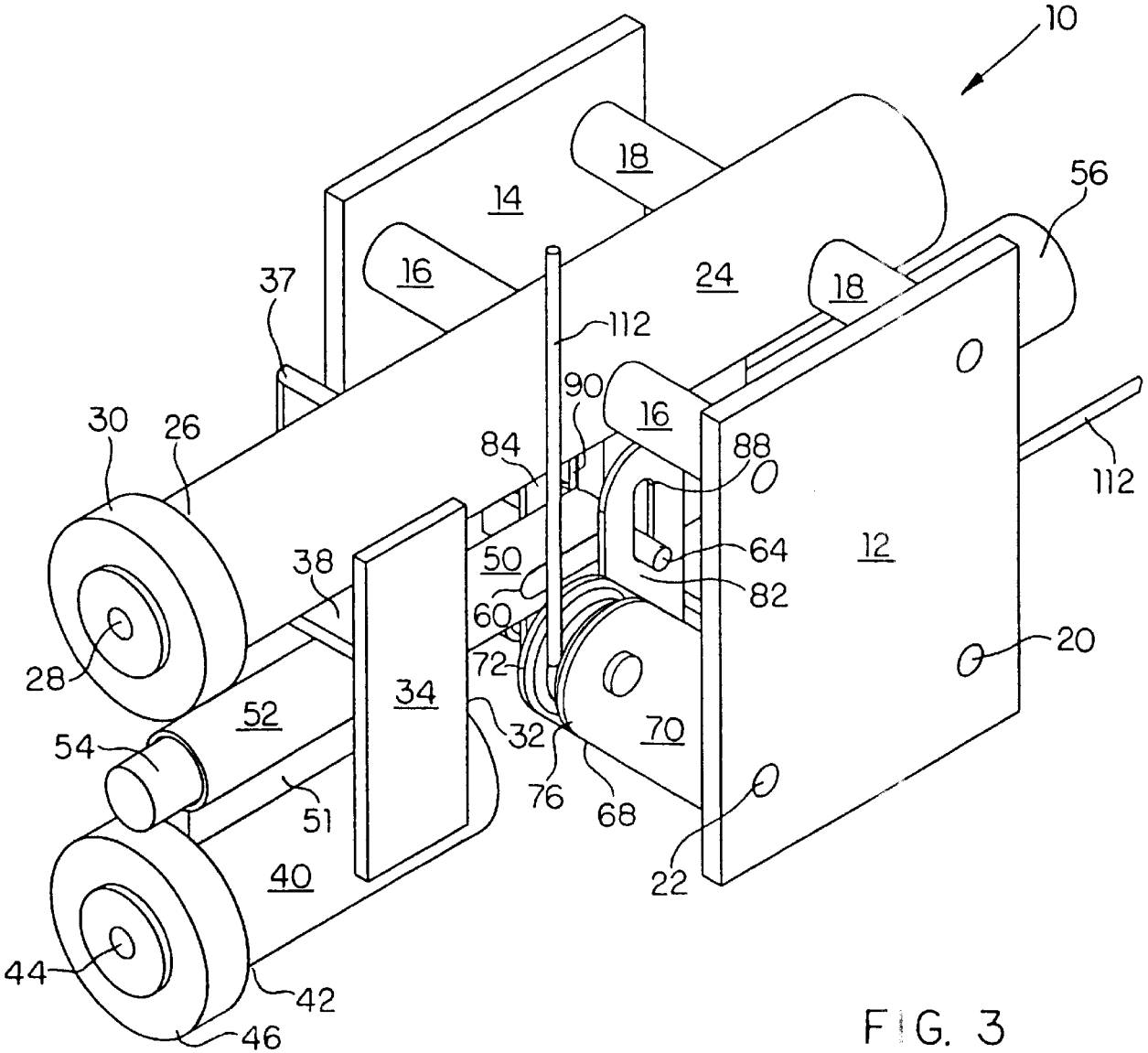
FIG. 3 is a perspective view of the fall arrestor and lockdown device of the present invention with the pin in a retracted position.

FIG. 3, with the upwardly rotated sensing arm 68 and retracted pin 54, is the configuration of fall arrestor and lockdown device 10 when the door 100 is raised via rotary motor 120 and tension is applied to cable 112 by the weight of the lower metallic beam 104.

Figure 4:
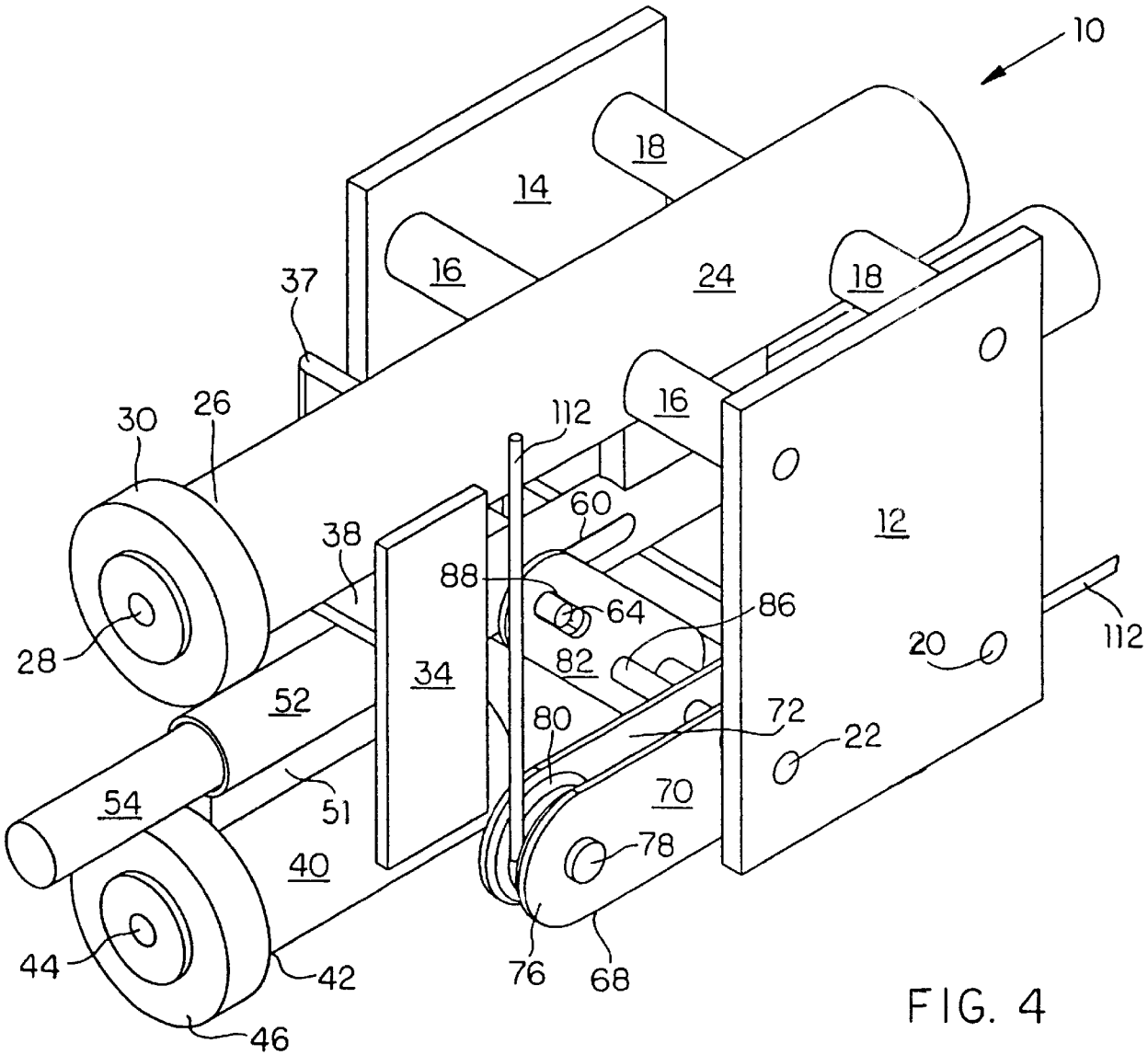
FIG. 4 is a perspective view of the fall arrestor and lockdown device of the present invention with the pin in an extended position.

FIG. 4, with the horizontal sensing arm 68 and extended pin 54, is the configuration of the fall arrestor and lockdown device 10 when tension is not applied to sensing arm 68 via cable 112 and coil spring 58 forces pin 54 into an extended position. Additionally, via the mechanical linkage, sensing arm 68 is forced to a horizontal position by coil spring 58. This occurs in two situations. The first situation is when cable 112 breaks or becomes unsecured while the door 100 is lifted. In this situation, the pin 54 is fired into an aperture 110 of guide channel 106 or 108 thereby arresting the fall of door 100, and device 10 acts as a fall arrestor. The second situation is when door 100 is fully lowered and the weight of lower metallic beam 104 comes to rest on the ground. The pin 54 then extends and inserts into an aperture 110 of guide channel 106 or 108 which is positioned near the ground. Device 10 acts as a lockdown device in this situation. When the door 100 is subsequently raised, the sensing arm 68 is tensioned by the cable 112 and the pin 54 automatically retracts allowing door 100 to be lifted. As the second situation occurs every time that the door 100 is closed, the fall arrestor and lockdown device 10 is regularly and periodically cycled without any special testing required. This helps assure that fall arrestor and lockdown device 10 properly maintained.

Figure 8:
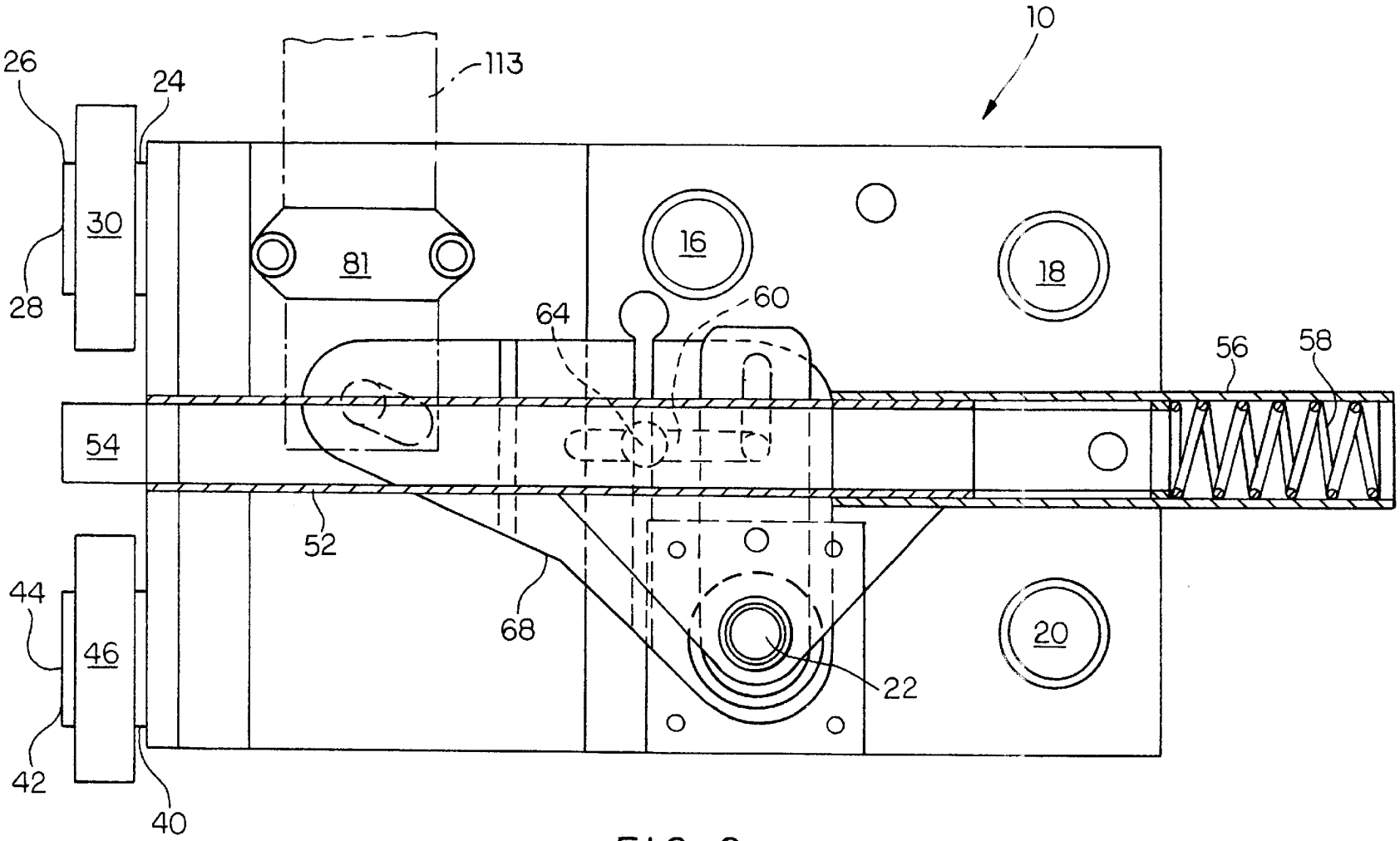
FIG. 8 is a side plan view, partially in phantom, of an alternative embodiment of the fall arrestor and lockdown device of the present invention with the pin in a retracted position.
Figure 9:
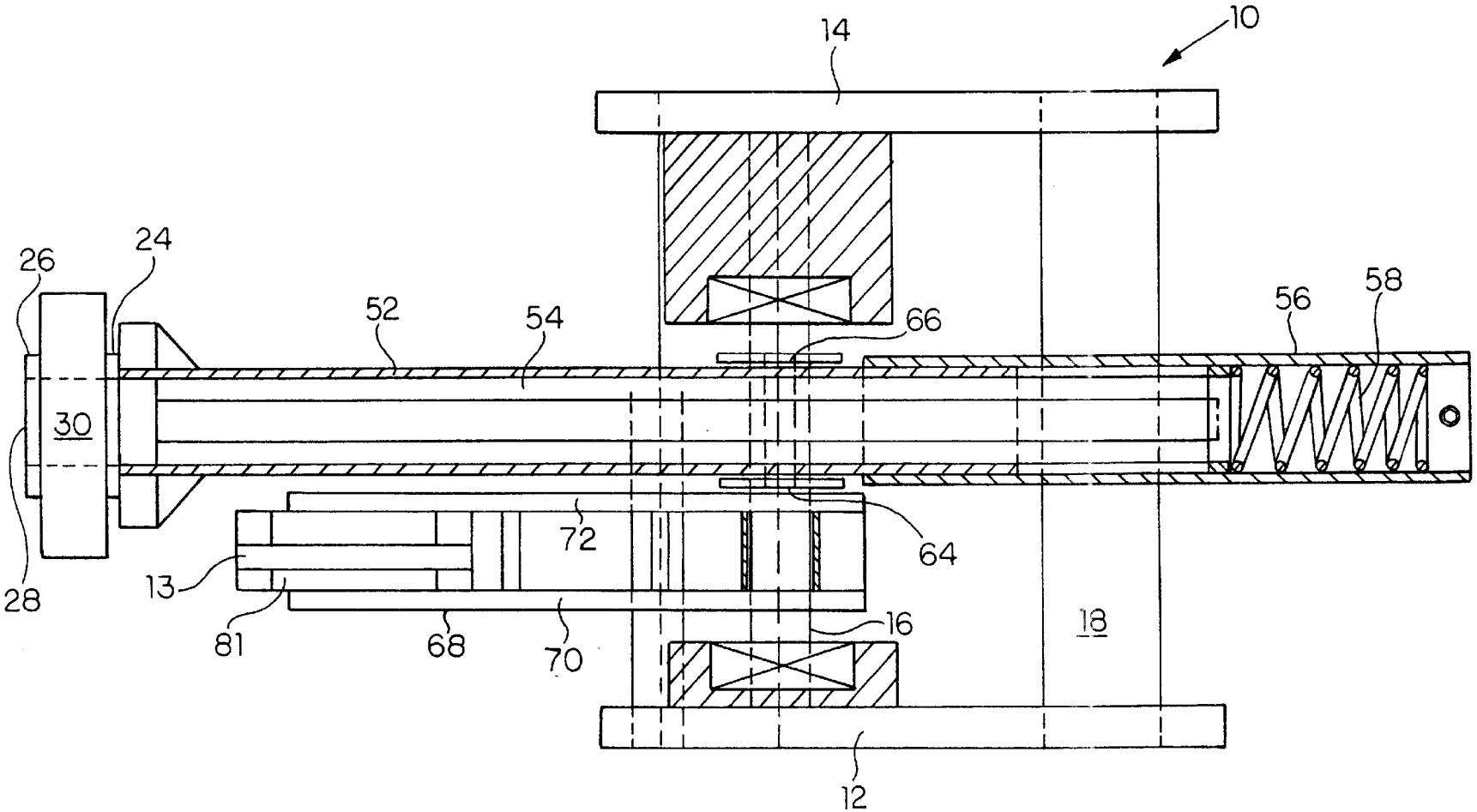
FIG. 9 is a top view, partially in phantom, of the alternative embodiment of the fall arrestor and lockdown device of the present invention.

An alternative embodiment is disclosed in FIGS. 8 and 9 and is particularly adapted to use with lift belts 113 which are directly attached to the sensing arm 68 by pivotally mounted clamp 81, in place of cable 112 passing through the pulley 80 of the embodiment shown in the previous figures. The use of the term "alternative" is intended in no way to imply that this embodiment is less desirable. It is merely used with a different drive system (lift belts versus cables). In the alternative embodiment, typically each side of the vertical lift door 100 has an individual fall arrestor and lockdown device 10 with an attached lift belt 113 which leads to a spool (not shown) above the door 100. The spools are typically driven by a common axle (not shown), driven in turn by a rotary motor (similar to element 120 of FIG. 1). Operation of the alternative embodiment is otherwise functionally identical or equivalent to that of the embodiment of the previous figures.

Thus the several aforementioned objects and advantages are most effectively attained. Although preferred embodiments of the invention has been disclosed and described in detail herein, it should be understood that this invention is in no sense limited thereby and its scope is to be determined by that of the appended claims.

What is claimed is:

1. A vertical lift door in combination with a device for arresting the movement of the vertical lift door, the door being operated by a cable or belt connected to the door such that it is used to vertically lift the door, whilst said door travels in oppositely disposed lateral guide members, the device comprising:

an arm coupled to the cable or belt which is used to vertically lift the door, said arm having a first position and a second position;

a latching pin being operatively coupled to said arm and responsive to said positions of said arm, said latching pin having a retracted position when said arm is in said first position and an extended position when said. arm is in said second position;

biasing means for moving said pin from the retracted position to the extended position;

wherein said arm is in said first position thereby said latching pin is in said retracted position when the cable or belt is tensioned by the weight of the door when the door is raised or lowered and wherein when said arm is in said second position said pin is moved laterally by the biasing means from the retracted position to the extended position when the cable or belt is relatively untensioned; and wherein when said pin is in said extended position said pin engages a laterally adjacent aperture located in at least one of said lateral guide members.

2. The device of claim 1 wherein said latching pin is mechanically linked to said arm.

3. The device of claim 2 wherein said latching pin reciprocates within a tubular housing between said extended position and said retracted position.

4. The device of claim 3 wherein said biasing means urges said latching pin to said extended position.

5. The device of claim 4 wherein said biasing means for urging comprises a coil spring.

6. The device of claim 5 wherein said latching pin includes at least one linkage pin extending perpendicularly from said latching pin through at least one lateral slot in said tubular housing.

7. A vertical lift door in combination with a device for arresting the movement of the vertical lift door, the door being operated by a cable or belt connected to the door such that it is used to vertically lift the door, the device comprising:

an arm coupled to the cable or belt which is used to vertically lift the door, said arm having a first position and a second position;

a latching pin mechanically linked and responsive to said positions of said arm, said latching pin reciprocating within a tubular housing and having a retracted position when said arm is in said first position and an extended position when said arm is in said second position;

a least one linkage pin extending perpendicularly from said latching pin through at least one lateral slot in said tubular housing;

at least one linkage element which moves in concert with said arm, said linkage element including at least one linkage slot engaging said linkage pin, whereby movement of said arm affects linear reciprocation of said latching pin within said tubular housing;

means for urging said latching pin to said extended position, thereby urging said arm to said second position when the cable or belt is relatively untensioned;

wherein said arm is in said first position thereby said latching pin is in said retracted position when said cable or belt is relatively tensioned by the weight of the door when the door is raised or lowered, and wherein when said arm is in said second position said latching pin is in said extended position when said cable or belt is relatively untensioned; and wherein when said latching pin is in said extended position said latching pin is adapted to engage a laterally adjacent aperture.

8. The device of claim 7 wherein said arm further includes the pulley designed to engage a cable or belt.

9. The device of claim 7 wherein said arm includes means for mechanically coupling it to the cable or belt.

10. The device of claim 8 or claim 9 wherein said arm rotates between said first position and said second position.

11. The device of claim 10 further including an upper roller support structure above said tubular housing and a lower roller support structure below said tubular housing, said upper and lower roller support structure including rollers for engaging guide channels.

* * * * *